US008789339B2

(12) United States Patent
Di Scola

(10) Patent No.: US 8,789,339 B2
(45) Date of Patent: Jul. 29, 2014

(54) METHOD FOR MAKING FAÇADES OF BUILDINGS

(71) Applicant: Tecnodima S.R.L., Cividate Al Piano (IT)

(72) Inventor: Orlando Di Scola, Milan (IT)

(73) Assignee: Tecnodima S.R.L., Cividate al Piano (IT)

( * ) Notice: Subject to any disclaimer, the term of this patent is extended or adjusted under 35 U.S.C. 154(b) by 0 days.

(21) Appl. No.: 13/722,503

(22) Filed: Dec. 20, 2012

(65) Prior Publication Data

US 2014/0174012 A1 Jun. 26, 2014

(51) Int. Cl.

| | |
|---|---|
| ***E04B 1/14*** | (2006.01) |
| ***E04F 13/00*** | (2006.01) |
| *E04B 1/76* | (2006.01) |
| *E04F 13/08* | (2006.01) |

(52) U.S. Cl.

CPC ..... *E04F 13/00* (2013.01); *E04B 1/762* (2013.01); *E04B 1/7675* (2013.01); *E04F 13/083* (2013.01); *E04B 1/7637* (2013.01)

USPC ..... 52/745.06; 52/745.05; 52/506.05; 52/405.3; 52/745.13

(58) Field of Classification Search

CPC ..... E04B 1/7675; E04B 1/762; E04B 1/7637; E04B 1/14; E04F 13/083; E04F 13/0801; E04F 13/088; E04F 13/0842; E04F 13/0844

USPC ..... 52/506.05, 512, 513, 381, 383, 407.4, 52/405.1, 405.4, 506.01, 506.06, 405.3, 52/404.2, 404.3, 404.5, 745.05, 745.06, 52/745.13, 745.21, 746.1

See application file for complete search history.

(56) References Cited

U.S. PATENT DOCUMENTS

| | | | | | |
|---|---|---|---|---|---|
| 1,086,821 | A | * | 2/1914 | Harter | 52/506.05 |
| 1,429,682 | A | * | 9/1922 | Megenity | 52/747.12 |
| 1,870,721 | A | * | 8/1932 | Foltz | 52/405.1 |
| 3,881,288 | A | * | 5/1975 | Fay | 52/223.13 |
| 4,329,821 | A | * | 5/1982 | Long et al. | 52/309.12 |
| 4,360,993 | A | | 11/1982 | Tomokazu et al. | |
| 4,545,163 | A | * | 10/1985 | Asselin | 52/378 |
| 5,063,721 | A | * | 11/1991 | Larsson | 52/379 |
| 5,280,690 | A | * | 1/1994 | Hu | 52/513 |
| 5,634,310 | A | * | 6/1997 | Hohmann | 52/513 |

(Continued)

FOREIGN PATENT DOCUMENTS

| | | | |
|---|---|---|---|
| DE | 19704112 | A1 | 6/1998 |
| EP | 0512973 | A1 | 11/1992 |
| GB | 2068071 | A | 8/1981 |
| IT | 1382734 | | 12/2008 |

*Primary Examiner* — Phi A

(74) *Attorney, Agent, or Firm* — Pearne & Gordon LLP

(57) ABSTRACT

Described is a method for making façades of buildings, comprising the following operations: fixing on an external wall (6) of a building a plurality of support elements (2), each projecting from the wall (6) and equipped with an insulating sleeve (4); applying and bonding to the wall (6) a plurality of insulating panels (15) made of expanded polystyrene, letting terminal ends (14) of the support elements (2), each surrounded by the respective insulating sleeve (4), protrude beyond the insulating panels (15); putting on the insulating sleeves (4) a plurality of bearing panels (16) made of fibre cement; applying and bonding the bearing panels (16) on the insulating panels (15); constraining a plurality of discrete finishing elements (23), such as stone slabs or tiles, to the bearing panels (16).

9 Claims, 4 Drawing Sheets

(56) References Cited

U.S. PATENT DOCUMENTS

| | | | | |
|---|---|---|---|---|
| 5,644,885 | A * | 7/1997 | Eischeid | 52/513 |
| 5,699,644 | A * | 12/1997 | Smith | 52/801.1 |
| 6,079,176 | A * | 6/2000 | Westra et al. | 52/404.2 |
| 6,351,918 | B1 * | 3/2002 | Westra et al. | 52/404.2 |
| 6,502,362 | B1 * | 1/2003 | Zambelli et al. | 52/698 |
| 6,609,339 | B1 * | 8/2003 | Pardue | 52/235 |
| 7,845,137 | B2 * | 12/2010 | Hohmann, Jr. | 52/714 |
| 8,375,667 | B2 * | 2/2013 | Hohmann, Jr. | 52/379 |
| 8,479,468 | B1 * | 7/2013 | Abbasi | 52/408 |
| 8,516,768 | B2 * | 8/2013 | Johnson, III | 52/713 |
| 2007/0125036 | A1 | 6/2007 | Schloemer et al. | |

* cited by examiner

METHOD FOR MAKING FAÇADES OF BUILDINGS

This invention relates to a method for making façades of buildings.

This invention is applied in the context of the systems for thermally insulating buildings on external walls of the building (commonly known by the term "cladding"). These systems should guarantee thermal insulation. between the rooms inside the building and the outside environment to avoid undesired losses of heat, from the inside to the outside in the winter and from the outside to the inside in the summer, so as to reduce to a minimum the quantity of energy used for heating/cooling rooms of the building and maximising the living comfort. There are prior art thermal insulation systems which use panels of insulating material bonded directly on the brick walls and then finished with the use of meshes, smoothing plaster and finishing materials. These systems do not allow the application of further elements for finishing the façade, such as stone slabs (made, for example, of marble) or tiles (made, for example, of clinker), which, due to their weight, cannot be safely constrained so the insulating panels.

There are also prior art façade finishes, so-called curtain walls, which use stone slabs supported by a metal frame anchored to the building with, if necessary, interposing of insulating panels supported by she same metal frame. This type of façade, described for example in patent. no. IT1382734 in the name of the same Applicant, cannot guarantee the necessary thermal cut-off, between the inside and outside of the building, for achieving the level of insulation which the bonded. insulations can guarantee.

Moreover, patent document DE19704112 illustrates a supporting element for connecting substructures for façades, roofs, floors etc., which comprises an insulating panel and a support panel positioned above the insulating panel and connected to the insulating panel and to the wall by means of a pin.

There is also patent document EP0512973 which illustrates a system for fixing insulating layers on ventilation ducts.

With regard to this, the Applicant felt the need to provide a bonded insulating covering which guarantees the maximum possible thermal insulation and at the same time allows the installation of finishing elements on the façade of she building.

More specifically, the Applicant felt the need to design a system for safely securing the finishing elements of the façade in the presence of bonded insulating panels. The Applicant found that she above-mentioned aims can be achieved using a plurality of support elements or brackets, each of which is firmly anchored to the wall of the building, made, for example, of concrete or brick, protrudes beyond the thickness of the insulation bonded on the wall and is provided with a coating of insulating material on which structural bearing panels rest to which the finishing elements are fixed.

In this description and in the appended claims the term "panels made of insulating material" means panels with a very low thermal conductivity coefficient "k", preferably less than 0.05 Kcal/(h m ° C.), preferably made of polystyrene (k=0.026–0.028 Kcal/(h m ° C.)). They are very light panels with a density preferably less than 100 kg/m3, preferably between 20 and 50 kg/m3.

The term "plates made of insulating material", "insulating plates" and "insulating bodies" mean elements made from a material with a low thermal conductivity coefficient "k", preferably less than 0.5 Kcal/(h m ° C.), preferably made of plastic material, preferably polypropylene (k=0.19 Kcal/(h m ° C.)).

The term. "bearing panels" means Panels with good. mechanical characteristics, for example made of metal, cement, fibre cement (cement matrix reinforced with organic, natural and/or synthetic fibres), so as to allow safe assembly on the panels of discrete finishing elements.

The term "discrete finishing elements" means, for example, stone slabs (made, for example, of marble), glass, metal, ceramic, tiles (made, for example, of clinker) and the like.

The term "mechanical constraining" means coupling not limited to joining by means of an adhesive or a bonding material but, in addition to or as an alternative to the bonding material, the use of mechanical elements such as screws, bolts, hooks, pins etc., or by welding.

More specifically, this invention relates to a method for making façades of buildings, comprising:

- securing to an external wall of a building a plurality of support elements, each comprising: a metal core presenting a first portion to be constrained to the wall of the building and a second portion projecting from the first portion; an insulating body surrounding the second portion; the bearing panels being supported. by the support elements anchored directly to the external wall of the building;
- applying and bonding to the external wall a plurality of insulating panels letting terminal ends of the second portions of the support elements, each surrounded by the respective insulating body, protrude beyond the insulating panels;
- putting on the insulating bodies of the terminal ends a plurality of bearing panels;
- applying and bonding the bearing panels to the insulating panels;
- constraining a plurality of discrete finishing elements to the bearing panels.

The Applicant has found that the use of the support elements and of the method according to this invention allows a good thermal cut-off to be provided and to guarantee a sound structural constraint between the wall of the building and the discrete external finishing elements. In effect, the bearing panels on which the discrete elements are attached are thermally insulated by the metal cores of the brackets by means of the insulating bodies on which they rest. Moreover, the bearing panels are supported safely by the brackets directly anchored to the wall of the building.

Preferably, each of the metal support elements, or brackets, has a right-angled shape with the first portion applied on the wall of the building and fixed to the wall by one or more plugs and the second portion, with the flattened shape, extending away from the wall.

The two portions are connected preferably by a reinforcement plate.

Moreover, preferably, between the first portion of each metal support element and the wall is interposed a plate or insulating material which helps to improve the thermal cut-off.

In a preferred embodiment, each insulating body is slipped. onto the second. portion of the respective support element during or after the application of the insulating panels and, preferably, the position of the insulating body is adjusted by making it slide on the second portion until the collar is brought against the insulating panels.

Moreover, preferably, the terminal ends of the support elements are treated to bring them flush with the bearing panels.

The support elements according to this invention can therefore be adapted to the thicknesses of the insulating panels and support panels used. It is sufficient to slide the insulating body onto the second portion until it protrudes beyond the insulating panels by just so much as necessary for receiving and supporting the respective bearing panel and then cut away the metal end in excess with respect to the bearing panel.

According to a preferred embodiment, the insulating body is a tubular sleeve with a rectangular cross-section.

It has a through opening with a rectangular cross-section shaped to match the cross-section of the second portion of the support element in such a way that it can be slipped onto it.

The sleeve also preferably has a collar made by moulding in one piece with the rest of the body.

The collar extends all the way round the sleeve like a wall with a thickness preferably of approximately 2 mm or 3 mm.

The collar remains interposed between the insulating panels and the bearing panels and keeps them mutually spaced, preventing an incorrect spreading of the bonding material from allowing mutual contact, so as to guarantee thermal insulation between the two.

Preferably, after application and bonding of the bearing panels to the insulating panels, an insulating plate is applied on the terminal end of each support element.

The insulating plate closes the metal end of the support element preventing the direct exposure of the end to the external environment and/or preventing contact of the end with the discrete finishing elements.

The insulating plate is bonded to the above-mentioned end of the support element and is also preferably locked by screws passing through the bearing panel and engaging in the collar of the support element.

Preferably, the discrete finishing elements are mechanically fixed to the bearing panels, for example using brackets fixed by plugs to the bearing panels. This configuration therefore provides a first layer of bonding material between the wall of the building and the insulating panels and a second layer of bonding material between the insulating panels and the bearing panels.

In an alternative embodiment, the discrete finishing elements are bonded to the bearing panels. This configuration therefore provides a first layer of bonding material between the wall of the building and the insulating panels, a second layer of bonding material between the insulating panels and the bearing panels and a third layer of bonding material between the bearing panels and the discrete finishing elements.

Other features and advantages will become more apparent from the detailed description a preferred non-limiting embodiment of a method for making façades of buildings and of a support element for making the façades according to this invention.

The detailed description of these configurations is set out below with reference to the accompanying drawings which are provided solely for purposes of illustration without restricting the scope of the invention and in which:

FIG. 1 schematically shows a cross-section of a insulating covering for external walls of buildings made with the method according to this invention;

Figure 2A:
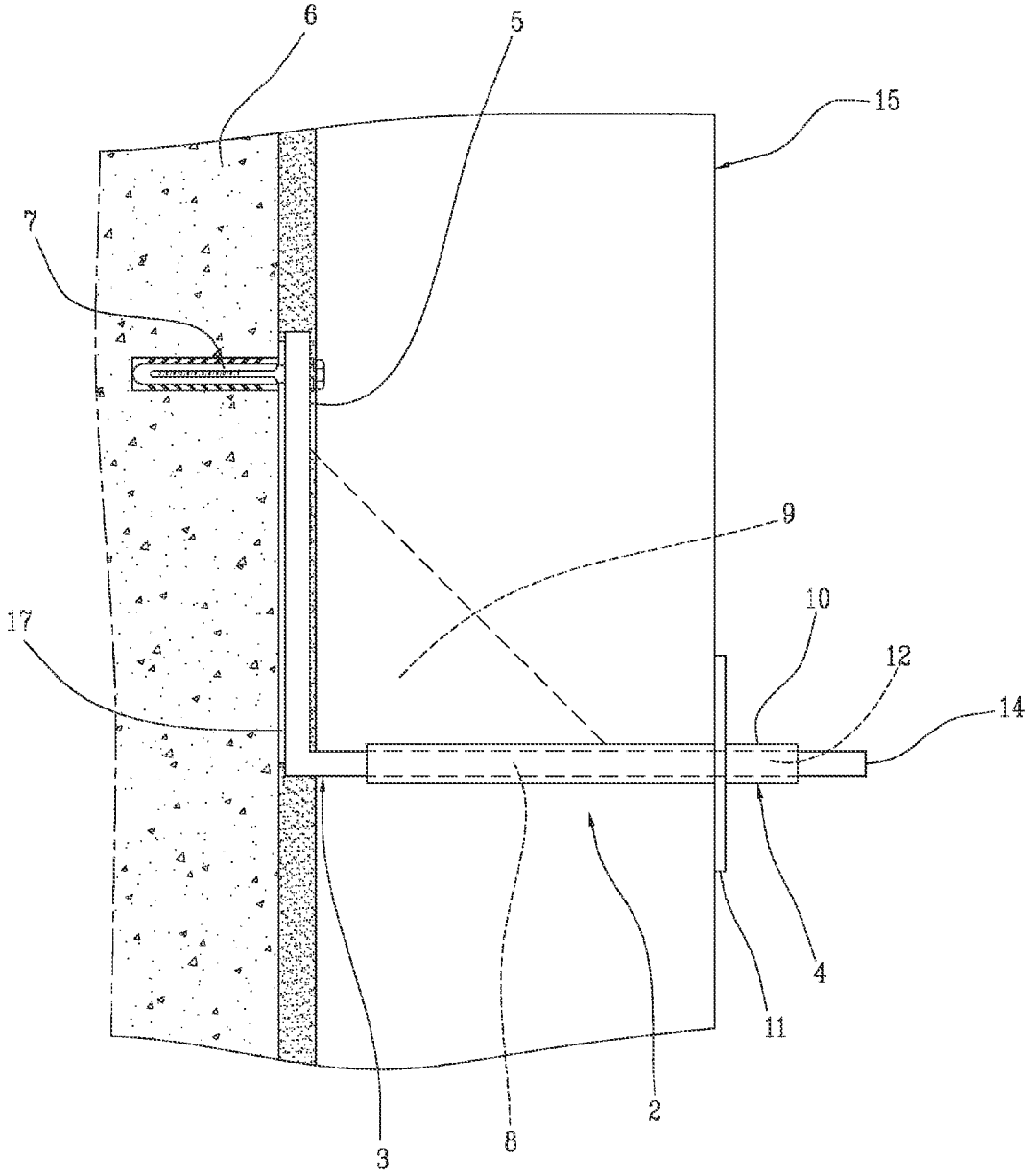
FIGS. 2A and 2B show an enlarged portion of the covering of FIG. 1 in respective steps of the method according to this invention.
Figure 2B:
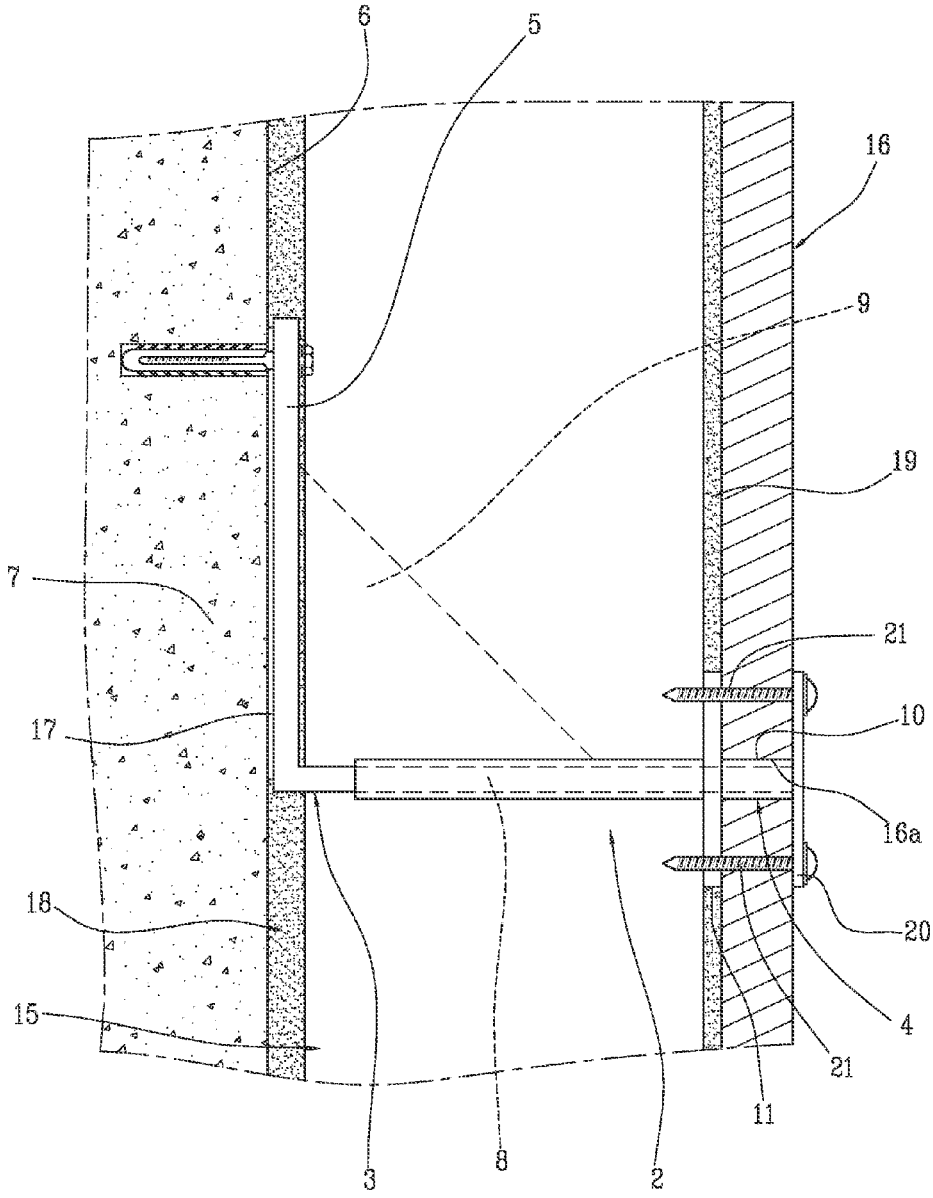
Figure 3:
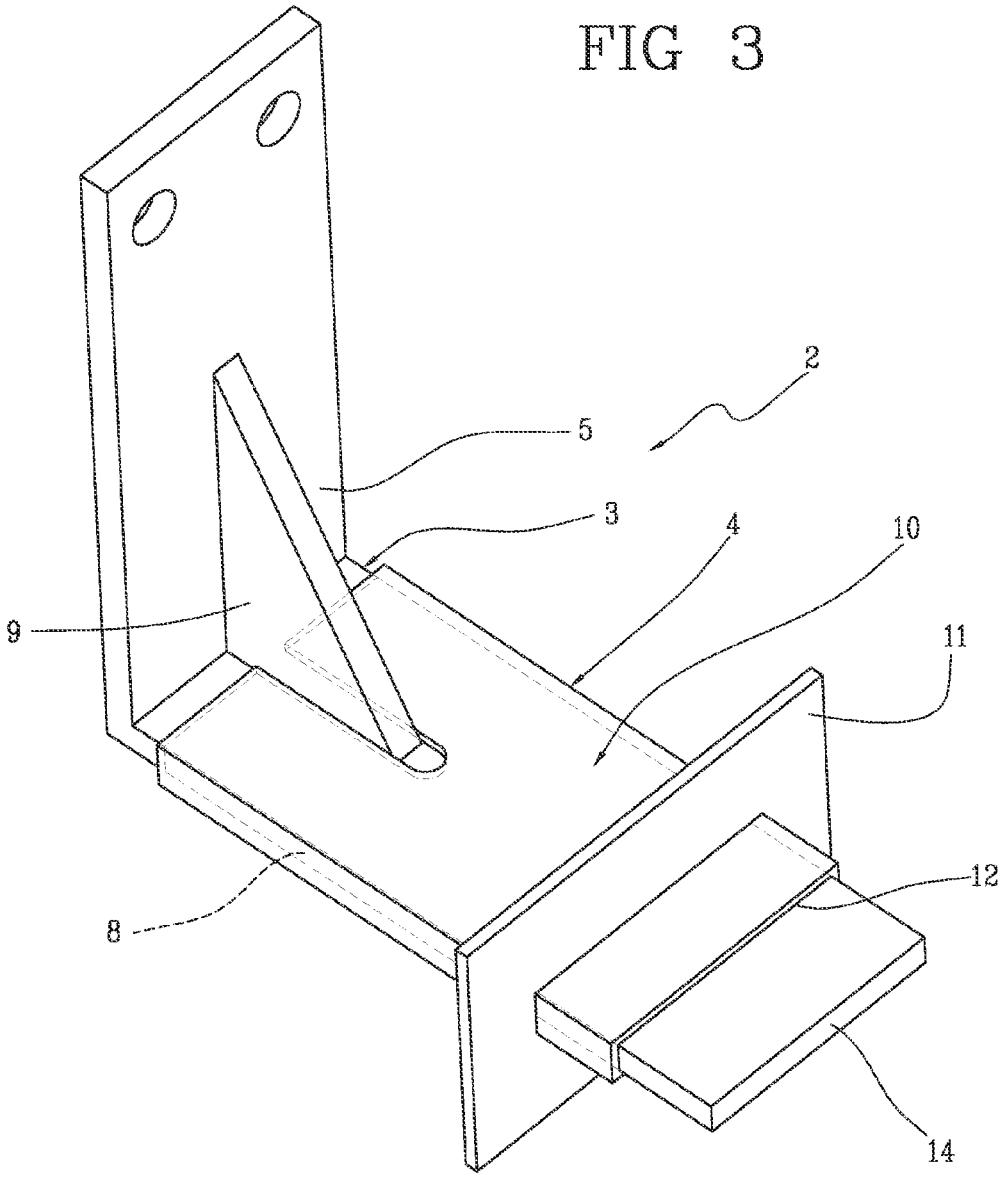
FIG. 3 is a perspective view of an element of the covering of FIGS. 1 and 2.

With reference to the accompanying drawings, the numeral 1 denotes in its entirety an insulating covering for buildings made with the use of support elements 2 of the type illustrated in detail in FIGS. 2A, 2B and 3.

Each support element 2 is a bracket consisting of a metal core 3, preferably made of stainless steel, and an insulating body 4, preferably made of polypropylene, which partly coats the metal core 3.

The metal core 3 comprises a first portion 5 having the shape of a rectangular plate designed to be placed against the wall 6 of a building (made, for example, of concrete or brick) and fixed to the wall 6 using, for example, plugs 7. A second portion 8 (also with the shape of a rectangular plate) of the metal core extends at right angles to the first portion 5 starring from an edge of it. The metal core 3 also preferably comprises a triangular reinforcement plate 9 which connects the first 5 and the second 8 portion.

The support element 2 is fixed to the building in such a way that the second portion 8 extends perpendicularly to the wall 6 and substantially parallel to the ground.

Purely by way of a non-limiting example, the second portion 8 has a length, measured along a direction at right angles to the wall 6, of approximately 170 mm, a length, measured along a horizontal direction parallel to The wall 6, of approximately 60 mm and a height, measured along a vertical direction parallel to the wall 6, of approximately 7 mm.

The insulating body 4 of the support element 2 is a sleeve made of insulating material, for example polypropylene, comprising a tubular body 10, shaped for slipping onto the second portion 8 of the metal core 3, and a collar 11 extending all the way round the the tubular body 10, in a plane parallel to the first portion 5. More specifically, the tubular body 10 has a rectangular cross-section with a rectangular through opening 12 designed to accommodate the second portion 8, with a minimum clearance sufficient to allow the sliding. The tubular body 10 has a fiat external surface 13 which, when it is installed on the support element 2 mounted on the wall, faces upwards and is substantially parallel to the ground. The collar 11 divides the tubular body 10 into two legs, one loner, facing the first portion 5, and one shorter, facing a terminal end 14 of the second portion 8.

Purely by way of a non-limiting example, the tubular body 10 is approximately 120 mm long, approximately 64 mm wide and approximately 10 mm high. The thickness of the wall of the tubular body 10 is approximately 1.5 mm-2 mm. That means that the cross-section of the through opening 12 has a width of approximately 60 mm and a height of approximately 7 mm. The longest leg is approximately 100 mm long and the shortest leg is approximately 20 mm long. The collar 11 has a thickness of approximately 2 mm or 3 mm, a width of approximately 100 mm and a height of approximately 60 mm.

The insulating covering 1 also comprises a plurality of insulating panels 15, preferably made of extruded expanded polystyrene, for the thermal insulation applied against the wail 6 and a plurality of bearing panels 16, preferably made of fibre cement, applied against the insulating panels 15.

The support elements 2 are preferably mounted on the wall with a spacing (horizontal and vertical) equal to the height (for example, equal to approximately 1200 mm) of the insulating panels 15 and of the bearing panels 16 and equal to half the width of the insulating panels 15 and bearing panels 16.

The support elements 2 are preferably mounted on the wall firstly without the respective insulating bodies 4 and interposing between the first portion 5 and the wall 6 a plate of insulating material 17, preferably made of polypropylene.

Figure 1:
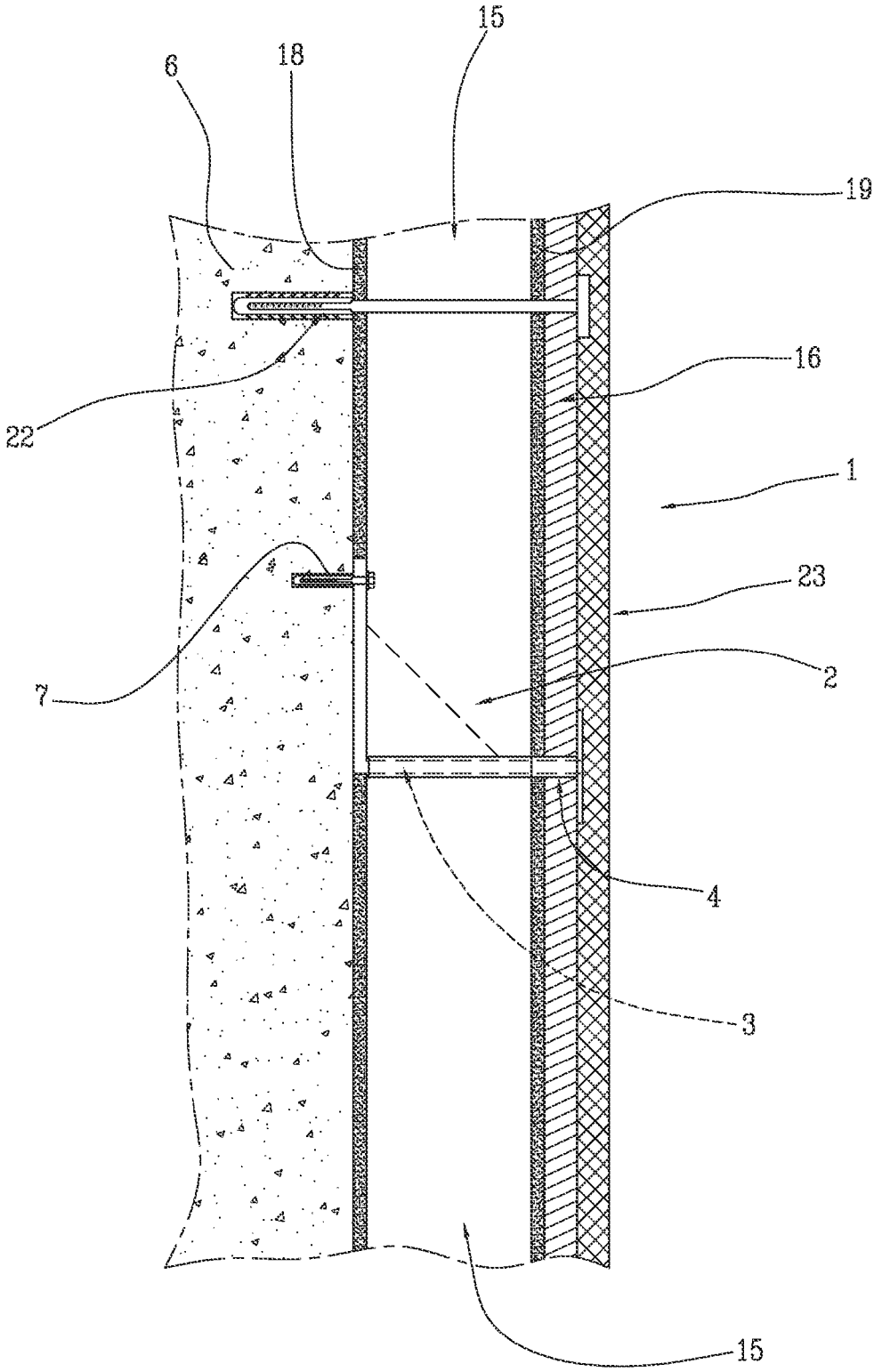

After the mounting of the support elements 2, the insulating panels 15 are applied against the wall 6 with a layer of bonding material 18, taking care that they are aligned and plumb. The support elements 2 remain interposed between adjacent insulating panels 15. FIG. 1 shows two insulating panels 15 positioned vertically one above the other.

Purely by way of a non-limiting example, the insulating panels 15 have a thickness of approximately 120 mm.

The insulating bodies 4 are now slipped onto the respective second portions 8 of the support elements 2 until the collars 11 are brought against the insulating panels 15.

The shortest leg of each insulating body 4 protrudes beyond the insulating panels 15 and the terminal end 14 of the second portion 8 of each metal core 3 protrudes beyond the shorter leg (FIG. 2A).

Next, lower edges 16*a* of the bearing panels 16 are placed on the shorter legs of the insulating bodies 4 and the bearing panels 16 are applied, with a layer of bonding material 19, against the insulating panels 15 and against the collars 11.

Purely by we of a non-limiting example, the bearing panels 16 have a thickness of approximately 13 mm.

The terminal ends 14 protruding and in excess of the metal cores 3 and, if necessary, part of the shorter legs are cut for bringing the support elements 2 flush with the bearing panels 16 and the ends 14 are covered by respective insulating plates 20, made, for example, of polypropylene. These insulating plates 20 are bonded with silicon and fixed with screws 21 which pass through the respective bearing panel 16 and are screwed into the respective collar 11 (FIG. 2B).

In order to guarantee the mechanical strength of the set/package formed by the insulating panels 15 and by the bearing panels 16 with even greater safety, heads 22 with a metal core and nylon coating can also be used which pass through the panels 15, 16 and the layers of bonding material 18, 19 and are driven into the wall 6 (FIG. 1).

Lastly, it is possible to install above the bearing panels 16 discrete finishing elements 23, such as stone slabs, clinker tiles etc., which can be bonded on the bearing panels 16 and/or preferably mounted with the use of brackets or other mechanical means constrained to the bearing panels 16.

Purely by way of a non-limiting example, the stone slabs 23 have a thickness of approximately 20 mm.

The invention claimed is:

1. Method for making façades of buildings, comprising:

securing to an external wall (6) of a building a plurality of support elements (2), each comprising: a metal core (3) presenting a first portion (5) to be secured to the wall (6) of the building and a second portion (8) projecting from said first portion (5); an insulating body (4) surrounding said second portion (8);

applying and bonding to said external wall (6) a plurality of insulating panels (15) letting terminal ends (14) of the second portions (8) of the support elements (2), each surrounded by the respective insulating body (4), protrude beyond said insulating panels (15);

putting on the insulating bodies (4) of said terminal ends (14) a plurality of bearing panels (16); the bearing panels (16) being supported by the support elements (2) directly anchored to the external wall (6) of the building;

applying and bonding said bearing panels (16) to the insulating panels (15);

constraining a plurality of discrete finishing elements (23) to said bearing panels (16).

2. Method according to claim 1, wherein each insulating body (4) is slipped onto the second portion (8) of the respective support element (2) during or after the application of the insulating panels (15).

3. Method according to claim 1, wherein the position of the insulating body (4) is adjusted making it sliding on the second portion (8).

4. Method according to claim 1, wherein a collar (11) of each insulating body (4) is brought against the insulating panels (16).

5. Method according to claim 4, wherein, during application and bonding of said bearing panels (16) to the insulating panels (15), said bearing panels (16) are applied against the collars (11).

6. Method according to claim 1, wherein, on securing the support elements (2), a small plate of insulating material (7) is interposed between the first portion (5) of each support element (2) and the external wall (6) of the building.

7. Method according to claim 1, wherein the terminal ends (14) of the support elements (2) are treated to bring them flush with the bearing panels (16).

8. Method according to claim 1, wherein, after application and bonding of said bearing panels (16) to the insulating panels (15), an insulating plate (20) is applied on the terminal end (14) of each support element (2).

9. Method according to claim 1, wherein the insulating body (4) comprises a sleeve (8) and a collar (11) made in a single piece by moulding.

* * * * *